United States Patent [19]

Böhm

[11] 4,203,249

[45] May 20, 1980

[54] FLYING SAUCER OR THROWING DISK USED IN SPORTS GAMES

[76] Inventor: Hans-Peter Böhm, Welfenstrasse 7, 75 Karlsruhe, Fed. Rep. of Germany

[21] Appl. No.: 879,757

[22] Filed: Feb. 21, 1978

[51] Int. Cl.[2] ..... A63H 27/00

[52] U.S. Cl. ..... 46/74 D; 273/425; 273/426; D21/86

[58] Field of Search ..... 46/79, 114, 74 D, 74 R; 273/106 B, 106 D, 105.4, 106 F; 272/106, 107; D34/5 L, 15 HS, 15 PP, 15 G; 244/23 C, 12.2; D21/85, 86

[56] References Cited

U.S. PATENT DOCUMENTS

| | | | |
|---|---|---|---|
| D. 220,272 | 3/1971 | Triplett | 273/103 B X |
| 1,368,176 | 2/1921 | McMillian | 273/106 D |
| 3,220,142 | 11/1965 | Butterfield | 273/106 F X |
| 3,613,295 | 10/1971 | Everett | 46/74 D |
| 3,955,817 | 5/1976 | Davis | 46/74 D |
| 3,959,915 | 6/1976 | Kettlestrings | 46/74 D |

FOREIGN PATENT DOCUMENTS

| | | | |
|---|---|---|---|
| 467331 | 12/1951 | Italy | 46/74 D |

*Primary Examiner*—John F. Pitrelli
*Assistant Examiner*—G. Lee Skillington
*Attorney, Agent, or Firm*—Craig & Antonelli

[57] ABSTRACT

A disk-shaped throwing implement comprising a central circular part provided with identical wings which are symmetrically distributed around its circumference is disclosed. Each of the wings comprises two sections or areas one of which is substantially planar and lying within the same plane as that of the central part, with the second wing section being curved or bent and projecting at an angle to the first wing section. The free rim of the first wing section being curved or bent in a direction opposite to the bend or curvature of the second wing section. One embodiment of the invention discloses that, additionally, the free outer rim of the second wing section is curved or bent in a direction opposite to the bend or curvature of the free rim of the first wing section.

19 Claims, 4 Drawing Figures

FLYING SAUCER OR THROWING DISK USED IN SPORTS GAMES

BACKGROUND AND SUMMARY OF THE INVENTION

This invention relates to a throwing disk having a circular, planar central part which is provided with substantially identical wings symmetrically distributed around its circumference.

Conventional throwing disks are known, for example, from DAS [German published application] No. 1,578,679 and U.S.Pat. No. 3,359,678. In these throwing disks, a curved, continuously extending edge adjoins the center part, the throwing disk being thin-walled and suitably made of a synthetic resin.

These conventional throwing disks permit a number of possibilities for sports and games, depending upon the skill and practice of the participants. However, these disks normally require at least two persons to play catch. The game possibilities for one person are limited to flinging the throwing disk forwardly at a tilt and allowing it to float back to the thrower on a cushion of air. In the case of several participants, the throwing disk can be aimed in each case only at one person. If the recipient fails to catch the disk, it will fall to ground.

The boomerang is a widely known article having the property of returning, if it has missed its target, to the thrower along an approximately circular path when the correct throwing technique is employed. Generally speaking, the boomerang is a relatively heavy article which can represent, upon its return to the thrower, danger if the latter is careless or inattentive.

It is an object of the present invention to provide a novel throwing disk exhibiting improved and/or additional uses as compared with conventional throwing disks while negating the danger factors inherent in the boomerang. In particular, the present throwing disk also affords the possibility of its flight continuing to a second person if the initial recipient fails to catch the disk, or of returning to the thrower in the manner of a boomerang. Therefore, the throwing disk may be used in play or a game by a solitary individual. Finally, the throwing disk is to be simple in its construction and inexpensive in its manufacture.

The above objects have been attained in accordance with the present invention in that a circular central part similar to the central planar portion of a conventional throwing disk of the type mentioned above, is provided, along its outer circumference, with wings radially projecting and symmetrically distributed therefrom in an identical manner. Each wing including a substantially planar first section or area directly adjoining the center part and lying substantially within the same plane as that of the center part and a second section or area adjoining and projecting from the first section essentially in the peripheral direction. The second sections of all of the wings are bent or curved in an identical direction out of the plane of the center part and first section. In this regard, it has been found to be advantageous in several embodiments of the present invention to have the second section or area of each wing adjoin the center part by way of an undercut portion.

It has proved to be advantageous in several embodiments of the present invention to start the bend or curvature of each of the second wing sections along the edge of the first wing section as traced by a line forming an angle of 40°-50°, preferably of 45° with a chord originating at the ending point of the respective wing and terminating at the starting point of the respective wing.

It has proved to be especially advantageous in many embodiments of the present invention to bend or curve the free rim of each first wing section in a direction opposite to the bend or curvature of their respective second wing section and additionally bend or curve the free outer rim of the second wing section, as viewed radially from the center of the center part, in a direction opposite to that of the bend or curve of the free rim of the respective first wing section.

It has also been found to be quite advantageous, in several embodiments of the present invention, that the center part of the throwing disk is a circular ring provided with a concentric opening or aperture. An additional embodiment of the present invention discloses that the inner edge of the opening formed by the circular ring is bent or curved in the direction of the bend or curve of the second wing sections.

Since the wings are symmetrically distributed along the outer circumference of the circular center ring part, the ending points of the respective wings in a six-winged embodiment would be located at points on said outer circumference of the circular center ring part and separated by an arc of 60°.

It has been found that such throwing disk according to the present invention combines the properties of conventional throwing disks with those of a boomerang, thus providing a great variety of possibilities for play and games for one person or for several individuals. The throwing disk of this invention can also be readily manufactured, for example, from a synthetic resin, and does not represent any danger due to its low mass and slow return, in the manner of a boomerang, to the thrower. Upon utilizing the correct throwing technique the improved throwing disk practically remains stationary in the air after its return to the thrower, so that even careless handling cannot lead to troublesome consequences.

Depending upon the flightpath desired and/or throwing technique utilized, the only essential factor for handling the throwing disk of the invention is merely to set the disk into rotation to a greater or lesser extent while throwing it in a peripheral direction opposite to the extension of the wings. The throwing technique also includes the respective position of the throwing disk in space with respect to the throwing direction and/or the wind direction.

Additional features and details of the invention can be seen from the following description with reference to the drawings which show, for purposes of illustration only, several embodiments in accordance with the present invention.

DETAILED DESCRIPTION OF THE INVENTION

Figure 1:
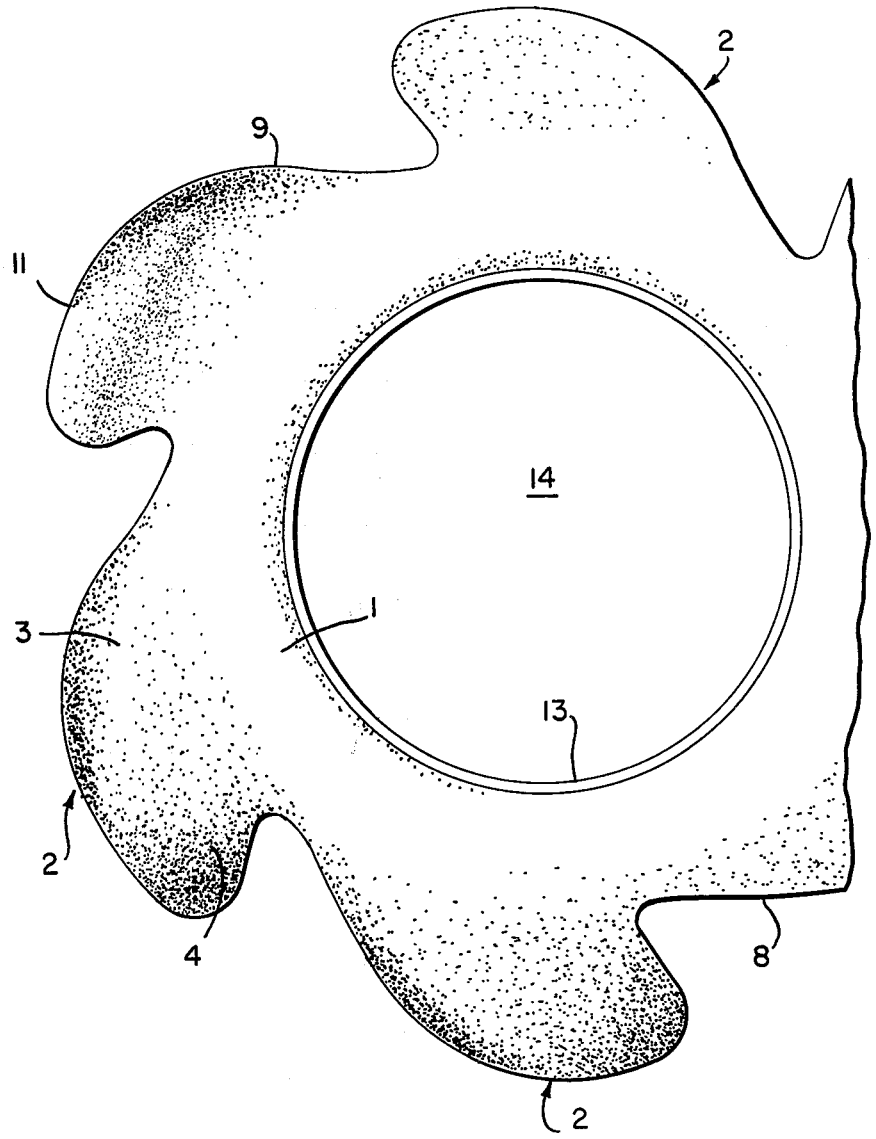
FIG. 1 shows the throwing disk in a plane view.
Figure 2:
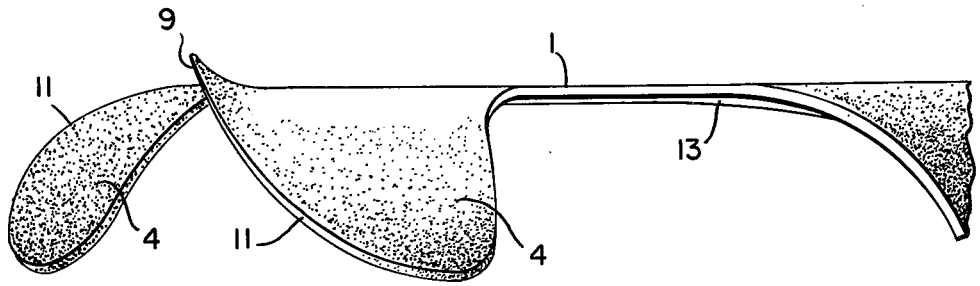
FIG. 2 shows the throwing disk according to FIG. 1 in a lateral view.
Figure 3:
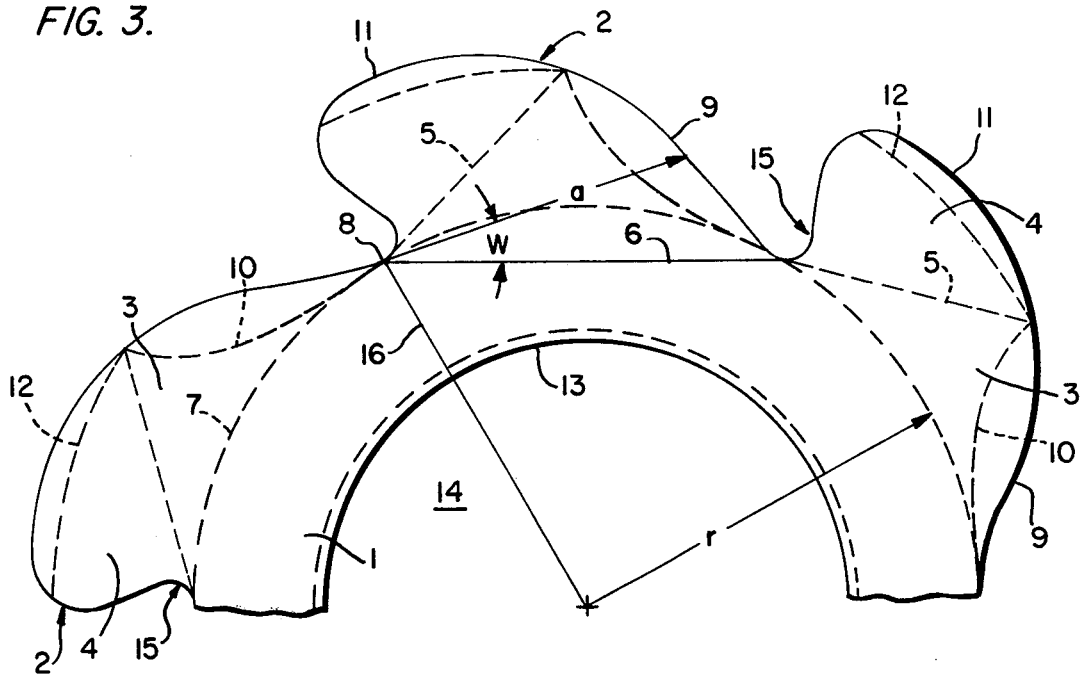
FIG. 3 shows the outer contour of the throwing disk according to FIG 1 in a planar projection.

According to FIGS. 1-3, the throwing disk of the present invention comprises a planar center part 1, having the shape of a circular ring, adjoined thereto by six identical wings 2, symmetrically distributed along the circumference of the said center part. The wings 2, include, first of all, a likewise substantially planar section 3, radially eminating directly from the center part 1, and a second section 4, adjoining the first section essentially in the peripheral direction and being bent or curved out of the plane of the center part 1. The angle formed by this bend or curvature being uniform and equal in all wings. The bend or curvature and thus the second wing section, begins along line 5, in FIG. 3, this line forming an angle of from 40°-50°, preferably 45° with the chord 6, of the outer arc 7, of the circumference of the center part, i.e. the line demarking the junction of first wing section 3, with the circular center part 1. The chord 6, originates at the ending point 8, located at the rear of the wing 2, and terminates at the starting point of the respective wing as seen in the peripheral direction.

The free rim 9, of the first wing section 3, is bent or curved in a direction opposite to the bend or curvature of the second wing section 4, wherein the bend the bend or curvature begins approximately along line 10, and, additionally, in one embodiment the free outer rim 11, of the second wing section 4, as viewed in the radial direction from the center point of the throwing disk, is bent or curved in a direction opposite to that of the curvature of the free rim 9, of the first wing section 3, wherein this bend or curvature begins approximately along the line 12. This proved to be advantageous in the model as illustrated, but basically is not a requirement for any other wing shape. In another embodiment, the inner edge 13, of the aperture 14, formed by the circular ring 1, is bent or curved downwardly in the direction of the bend or curvature curvature of the second wing section 4.

FIG. 3 shows the throwing disk according to FIG. 1 in a planar projection, i.e., with wings 2, placed flat into the plane of the center part 1. if, as in this case, the outer arc, i.e. circumference of the circular center ring part 1, has the radius r an especially suitable contour of the wings 2 can be obtained by an arcuate connection of the end points of radial rays a rotating about the wing ending point 8, in the counterclockwise direction, for angles w measured with the intersection of chord 6 with the outer arc 7 as the starting point, with w and a having the following values;

TABLE 1

| | |
|---|---|
| w = 0 | a = r |
| w = 30° | a = 0.752r |
| w = 60° | a = 0.594r |
| w = 90° | a = 0.477r |
| w = 120° | a = 0.277r |
| w = 90° | a = 0.112r (undercut) |

The last value listed above is produced by rotating the ray a backwards in the clockwise direction which results in imparting an undercut 15, to the wings 2. These values for w and a fall within the following general formula:

TABLE II

| | |
|---|---|
| w = 0° | a = r |
| w = 30° | a = 0.7-0.8r |
| w = 60° | a = 0.55-0.65r |
| w = 90° | a = 0.45-0.5r |
| w = 120° | a = 0.25-0.35r |
| w = 90° | a = 0.1-0.2r (undercut) |

Another general formula of note is:

TABLE III

| | |
|---|---|
| w = 0° | a = r |
| w = 30° | a = 0.6-0.9r |
| w = 60° | a = 0.4-0.8r |
| w = 90° | a = 0.35-0.55r |
| w = 120° | a = 0.15-0.4r |
| w = 90° | a = 0.05-0.25r (undercut) |

The throwing disk is handled by throwing it away from the body, i.e., imparting to the disk a translational motion component and giving it an initial rotation in a clockwise direction, based upon FIGS. 1 and 3, i.e., imparting to the disk a rotational motion component oriented in opposition to the extension of the wings 2, in the peripheral direction. This imparting of the two motion components, especially the rotational motion component, can be effected and/or supported by hooking the rubberband of a slingshot into the undercut portion 15 of one of the wings and thus practically firing the throwing disk, which is held in the free hand, out of the free hand.

Figure 4:
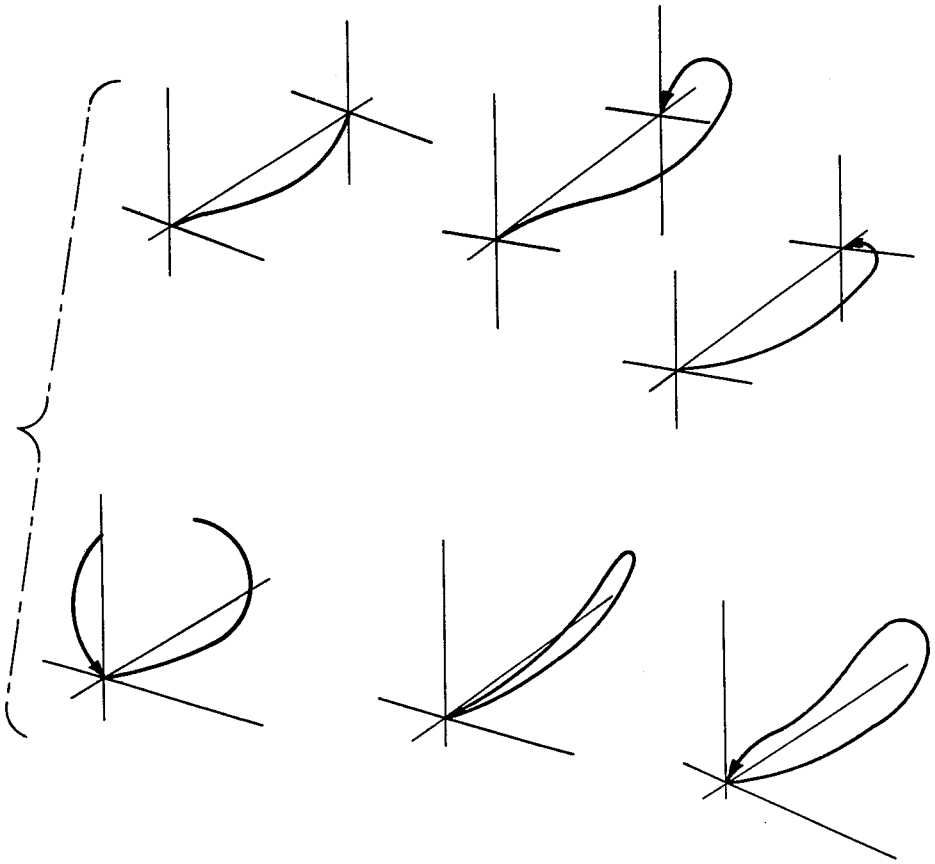
FIG. 4 shows several trajectories possible with the throwing disk of this invention.

Depending upon the throwing technique and throwing expertise, i.e., depending on the size of the translational and/or rotational motion component, as well as the special position of the throwing disk during the instance of throwing, a great variety of trajectories can be produced, several of which are illustrated in FIG. 4. In this connection, it is possible, in particular, to attain the more or less large, closed trajectory shown at the bottom of FIG. 4, along which the throwing disk returns to the thrower in the manner of a boomerang.

It has been found that a six-winged throwing disk of the type described in detail with reference to the drawings is just about optimal. If the number of wings is reduced, the throwing disk does not appear to have sufficient supporting points during flight while its behavior, if the number of wings is increased, approaches that of the known throwing disk mentioned in the introduction.

By having the aperture 14, within the throwing disk, the moment of inertia of the disk is only slightly affected, whereas the influence of wind on the disk is greatly reduced and the mass of the disk is considerably decreased. In this regard, the bent edge 13, aids, especially when the disk is floating downward, in maintaining a certain air cushion underneath the disk.

Experience has shown that when the bend or curvature of the free outer rim 11 of the second wing section is increased, the curvature of the second wing section 4, must also be enlarged. Furthermore, the curvature of the second wing section 4, should be selected according to the mass of the throwing disk in a like increasing or decreasing fashion. The bend or curvature of the rim 11 free outer influences the curved flight behavior in accordance with the illustration at the bottom of FIG. 4.

As experience has shown, the planar configuration of the center part, as well as that of the first wing sections 3, also represent a preferred embodiment since a curvature in one or the other direction impairs the flight properties of the throwing disk. However, the curvatures of the second wing section 4, free rim 9, and free outer rim 11 should be maintained at a minimum to reduce the aerodynamic drag of the throwing disk and thus increase its range.

With a radius of r=8,9 centimeters of the outer circumference of the center part, a throwing disk with a weight of about 47.5 grams has proven to be especially advantageous. In this embodiment the edge 13 of the inner circle or aperture should have a radius of 6,0 centimeters and the contour of the wings is as given in Table I above.

Based on FIG. 3, the following alternative wing contour also proved to be very advantageous:

TABLE IV

| | |
|---|---|
| w = 0° | a = r |
| w = 21.2° | a = 0.789r |
| w = 42.8° | a = 0.678r |
| w = 60° | a = 0.578r |
| w = 90° | a = 0.460r |
| w = 105.5° | a = 0.416r |
| w = 120° | a = 0.269r |
| w = 90° | a = 0.095r (undercut) |

r = 9,5 cm; weight 70–85 grams, preferably 80 grams; radius of the inner circle = 6.6 cm.

These values for w and a fall within the following general formula:

TABLE V

| | |
|---|---|
| w = 0 | a = r |
| w = 21.2° | a = 0.75–0.85r |
| w = 42.8° | a = 0.65–0.7r |
| w = 60° | a = 0.55–0.6r |
| w = 90° | a = 0.4–0.5r |
| w = 105.5° | a = 0.35–0.45r |
| w = 120° | a = 0.2–0.3r |
| w = 90° | a = 0.08–0.2r (undercut) |

Another, more general formula of note is:

TABLE VI

| | |
|---|---|
| w = 0° | a = r |
| w = 21.2° | a = 0.7–0.9r |
| w = 42,8° | a = 0.6–0.75r |
| w = 60° | a = 0.5–0.65r |
| w = 90° | a = 0.35–0.55r |
| w = 105.5° | a = 0.3–0.5r |
| w = 120° | a = 0.15–0.4r |
| w = 90° | a = 0.0–0.3r (undercut) |

The maintenance of the following conditions proved to be advantageous in generating the outer contour of the wings:

(a) The line parallel to the above-described chord 6 which passes through the center of gravity of the equilateral triangle constructed from the said chord in the radially outward direction toward the wing forms an angle of 45° with the outer contour of the wing on the side of the said parallel line opposite from the said chord 6;

(b) With w=60° the outer wing contour is parallel to the chord 6;

(c) With w=90° the outer wing contour is a tangent of the circle around the center of the disk circumscribing the wings; and (d) With w=120° the outer wing contour is a tangent to the radial ray 16 eminating from the center of the disk.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

The range of the angular orientation of the joint sections lies between 30° and 70°; in a preferred embodiment the angle is about 30°–35°. The second sections which are bent down have at their lowest rim a distance from the plane of the center part that is about 14–20 mm if one takes one of the described preferred embodiments.

I claim:

1. A throwing disk comprising:

(a) a substantially planar, central ring part having an aperture, an inner edge, and an outer circumference;

(b) a plurality of wings distributed about said outer circumference; each of said wings comprising:

(1) a substantially planar first wing section directly adjoining said outer circumference and being substantially co-planar with said central ring part;

(2) a second wing section with a free outer rim, said second wing section adjoining said first wing section and extending, with respect to said outer circumference, essentially in a peripheral direction and being bent with respect to said first wing section; and (3) a further free rim adjoining the first wing section; wherein:

(i) said second wing section is bent in such manner that said bend is located along an edge of said first wing section which forms an angle of between 40°–50° with a chord of the outer circumference of said central ring portion, said cord originating at the ending point of the first wing section and terminating at the starting point of the first wing section with respect to said outer circumference of the central ring part and;

(ii) said further free rim of said first wing section is bent in a direction opposite to the bend of said second wing section such that when said central ring part is in a horizontal position, the bends of said free rim and said second wing section extend in respective upward and downward directions.

2. A throwing disk according to claim 1, wherein said angle is 45°.

3. A throwing disk according to claim 1, wherein said bends are curves.

4. A throwing disk according to claim 1, wherein said free outer rim of said second wing section is bent in a direction opposite to the bend of said free rim of said first wing section.

5. A throwing disk according to claim 1, wherein the inner edge of said central ring part is bent substantially in the direction of the bend of said second wing section.

6. A throwing disk according to claims 1 or 3, wherein a planar projection of an outer contour of each wing is generated by an arcuate connection of end points of radial rays a, said rays forming an angle w with said outer circumference cord.

7. A throwing disk according to claim 3, wherein said free outer rim of said second wing section is curved in a direction opposite to the curve of said free rim of said first wing section.

8. A throwing disk according to claim 3, wherein the inner edge of said central ring part is curved substantially in the direction of the curve of said second wing section.

9. A throwing disk according to claims 1 or 3, wherein said second wing section adjoins said central ring part by way of an undercut.

10. A throwing disk according to claim 6, wherein said end points are approximately determined by the application of the following mathematical formula:

| | |
|---|---|
| w = 0° | a = r |
| w = 30° | a = 0.7–0.8r |
| w = 60° | a = 0.55–0.65r |
| w = 90° | a = 0.45–0.5r |
| w = 120° | a = 0.25–0.35r |
| w = 90° | a = 0.1–0.2r |

11. A throwing disk according to claim 6, wherein said end points are approximately determined by the following mathematical formula:

| | |
|---|---|
| w = 0° | a = r |
| w = 21.2° | a = 0.75–0.85r |
| w = 42.8° | a = 0.65–0.7r |
| w = 60° | a = 0.55–0.6r |
| w = 90° | a = 0.4–0.5r |
| w = 105.5° | a = 0.35–0.45r |
| w = 120° | a = 0.2–0.3r |
| w = 90° | a = 0.08–0.2r (undercut) |

12. A throwing disk according to claim 6, wherein said end points are approximately determined by the application of the following mathematical formula:

| | |
|---|---|
| w = 0° | a = r |
| w = 30° | a = 0.6–0.9r |
| w = 60° | a = 0.4–0.8r |
| w = 90° | a = 0.35–0.55r |
| w = 120° | a = 0.15–0.4r |
| w = 90° | a = 0.05–0.25r (undercut) |

13. A throwing disk according to claim 6, wherein said end points are approximately determined by the application of the following mathematical formula:

| | |
|---|---|
| w = 0° | a = r |
| w = 21.2° | a = 0.7–0.9r |
| w = 42.8° | a = 0.6–0.75r |
| w = 60° | a = 0.5–0.65r |

-continued

| | |
|---|---|
| w = 90° | a = 0.35–0.55r |
| w = 105.5° | a = 0.3–0.5r |
| w = 120° | a = 0.15–0.4r |
| w = 90° | a = 0.0–0.3r (undercut) |

14. A throwing disk according to claim 6, wherein:

(a) at w=60°, the outer contour is parallel to said outer circumference chord;

(b) at w=90°, the outer contour is tangent to a circle which circumscribes the wings and is concentric with said outer circumference of said central ring part;

(c) at w=120°, the outer contour of the wing is tangential to the radius of said central ring part.

15. A throwing disk according to claims 1, 3 or 8, wherein a distance from said inner edge of an inner circumference of the central ring part to said chord of said outer circumference is at least 1.5 times a maximum distance between said chord and said outer circumference.

16. A throwing disk according to claims 1, 3, 4, 5, 7 or 8 wherein said throwing disk is provided with six wings with said outer circumference chords forming a hexagon which is circumscribed by said outer circumference.

17. A throwing disk according to claim 9, wherein a distance from said inner edge of an inner circumference of the central ring part to said cord of said outer circumference is at least 1.5 times a maximum distance between said chord and said outer circumference.

18. A throwing disk according to claim 9, wherein:

| | |
|---|---|
| w = 0° | a = r |
| w = 30° | a = 0.752r |
| w = 60° | a = 0.594r |
| w = 90° | a = 0.477r |
| w = 120° | a = 0.277r |
| w = 90° | a = 0.112r (undercut) |

19. A throwing disk according to claim 11, wherein:

| | |
|---|---|
| w = 0° | a = r |
| w = 21.2° | a = 0.789r |
| w = 42.8° | a = 0.678r |
| w = 60° | a = 0.578r |
| w = 90° | a = 0.460r |
| w = 105.5° | a = 0.416r |
| w = 120° | a = 0.269r |
| w = 90° | a = 0.095r (undercut) |

* * * * *